US007611330B1

(12) United States Patent
Liang

(10) Patent No.: US 7,611,330 B1
(45) Date of Patent: Nov. 3, 2009

(54) TURBINE BLADE WITH TRIPLE PASS SERPENTINE FLOW COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 639 days.

(21) Appl. No.: 11/584,479

(22) Filed: Oct. 19, 2006

(51) Int. Cl.
*F01D 5/18* (2006.01)

(52) U.S. Cl. ..... 416/97 R

(58) Field of Classification Search ..... 416/97 R; 415/115

See application file for complete search history.

(56) References Cited

U.S. PATENT DOCUMENTS 4,859,147 A 8/1989 Hall et al.
5,165,852 A * 11/1992 Lee et al. ..... 416/97 R
5,253,976 A 10/1993 Cunha
5,348,446 A 9/1994 Lee et al.
5,356,265 A 10/1994 Kercher
5,538,394 A * 7/1996 Inomata et al. ..... 416/97 R
6,129,515 A 10/2000 Soechting et al.
6,595,748 B2 7/2003 Flodman et al.
6,705,836 B2 3/2004 Bourriaud et al.
6,916,155 B2 7/2005 Eneau et al.
2007/0128034 A1 * 6/2007 Lee et al. ..... 416/97 R

* cited by examiner

*Primary Examiner*—Edward Look
*Assistant Examiner*—Aaron R Eastman
(74) *Attorney, Agent, or Firm*—John Ryznic

(57) ABSTRACT

A turbine blade used in a gas turbine engine, the blade having a dual triple pass serpentine flow cooling circuit to provide cooling to the blade. A first triple pass serpentine flow circuit includes a first leg located on the pressure side, a second leg located on the suction side and directly opposed to the first leg, and a third leg located aft of the first and second leg and between the pressure side and suction side walls. A shower-head cooling arrangement is supplied cooling air through metering holes connected to the third leg. A second triple pass serpentine flow circuit is located downstream from the first serpentine flow circuit and includes a first leg on the pressure side of the blade, a second leg on the suction side and directly opposed to the first leg, and a third leg downstream from the first and second leg and between the pressure side and suction side walls, the third leg including trailing edge exit cooling holes.

8 Claims, 3 Drawing Sheets

TURBINE BLADE WITH TRIPLE PASS SERPENTINE FLOW COOLING CIRCUIT

BACKGROUND OF THE INVENTION

1. Field of the Invention

The present invention relates generally to fluid reaction surfaces, and more specifically to turbine airfoils with a serpentine flow cooling circuit.

2. Description of the Related Art Including Information Disclosed Under 37 CFR 1.97 and 1.98

A gas turbine engine produces mechanical energy from the burning of hydrocarbons such as natural gas and oil. In a gas turbine engine, such as an industrial gas turbine engine (IGT), a compressor provides compressed air to a combustor, where the fuel is burned and an extremely hot gas flow produced. The hot gas flow is passed I through a turbine of multiple stages in order to convert the energy from the hot gas flow into mechanical energy that drives the turbine shaft. In order to increase the efficiency of the engine, the hot gas flow into the turbine is increased. The highest temperature usable is dependent upon the material properties of the turbine. The first stage stator vanes and rotor blades in the turbine are exposed to the hottest temperature. Thus, the maximum temperature is limited to the maximum temperature limits for these parts.

One method of allowing for even higher temperatures in the turbine is to provide cooling air for the vanes and blades in the turbine. complex cooling circuits have been proposed to provide for the maximum amount of airfoil cooling while using the minimum amount of cooling air. Since the cooling air used within the airfoil passages is generally diverted from the compressor (bleed off air), minimizing the amount of bleed off air required for cooling also will increase the efficiency of the engine. Hot spots on the airfoils are also a problem that must be dealt with. Because of the complex cooling circuits, some parts of the airfoil may be over-cooled while another part may be under-cooled.

Prior art airfoil cooling include the use of a triple pass serpentine flow cooling circuit as shown in FIG. 1. This includes a forward flowing triple pass and an aft flowing flow circuit. The forward flowing flow circuit normally is designed in conjunction with leading backside impingement plus showerhead and pressure side and suction side film discharge cooling holes. The aft flowing serpentine flow circuit is designed in conjunction with airfoil trailing edge discharge cooling holes. This type of cooling flow circuit is called a dual triple pass serpentine "warm bridge" cooling concept. The forward flowing serpentine circuit includes a first leg 11 having an upward flow direction, a second leg 12 with a downward flow direction, and a third leg 13 with an upward flow direction. A leading edge supply channel 14 with showerhead cooling holes 15 discharges cooling air, and metering holes 16 supply cooling air from the third leg 13 to the supply channel 14. The aft flowing serpentine circuit includes a first leg 21 with an upward flow direction, a second leg 22 with a downward flow direction, and a third leg 23 with an upward flow direction, and exit cooling holes 24 connected to the third leg 23.

Another prior art cooling flow circuit is shown in FIG. 2. This is a dual triple pass serpentine flow circuit for a high operating gas temperature and is referred to as the "cold bridge" cooling concept. In this particular design, the leading edge airfoil is cooled with a self-contained flow circuit. The airfoil mid-chord section is cooled with a triple pass serpentine flow circuit. However, the aft flow circuit is flowing forward instead of aft ward like in the warm bridge design of FIG. 1. The aft flowing serpentine flow circuit is designed in conjunction with airfoil trailing edge discharge cooling holes. The mid-chord serpentine flow circuit includes a first leg 31 with an upward flow direction, a second leg 32 with a downward flow direction, and a third leg 33 with an upward flow direction. The self-contained leading edge cooling circuit includes a supply channel 35, a metering hole 38, a leading edge channel 36, and a showerhead arrangement of cooling holes 37. The aft flow serpentine circuit includes a first leg 41 with an upward flow direction, a second leg 42 with a downward flow direction, and a third leg 43 with an upward flow direction. Trailing edge exit holes are connected to the first leg 41.

In both the warm bridge and the cold bridge designs of the prior art above, the internal cavities are constructed with internal ribs connecting the airfoil pressure and suction walls. In most of the cases, the internal cooling cavities are at low aspect ration which is subject to high rotational effects on the cooling side heat transfer coefficient. The low aspect ration cavity yields a very low internal cooling side convective area ratio to the airfoil hot gas external surface.

An object of the present invention is to provide for an airfoil serpentine cooling circuit which optimizes the airfoil mass average sectional metal temperature to improve airfoil creep capability for a blade cooling design.

BRIEF SUMMARY OF THE INVENTION

A turbine blade with a dual triple pass cooling flow circuit is proposed. In a warm bridge cooling circuit, a mid-chord cooling cavity is oriented in the chordwise direction to form a high aspect ration formation. Cooling air is fed into the forward flowing serpentine flow circuit and an aft flowing serpentine flow circuit in which a first leg is formed on the pressure side of the up-pass cooling cavity. The cooling air is then directed to flow downward in the second leg through the airfoil suction side cooling channel and then directed to flow upward in the third leg to the airfoil leading and trailing edge cooling channels for the cooling of both leading edge and trailing edge regions.

In a second embodiment, the forward flowing serpentine flow circuit has a first leg in an upward flowing pressure side channel, a second leg in a downward flowing suction side channel, and the third leg in an upward flowing pressure side channel adjacent of the first leg pressure side channel. A leading edge and showerhead arrangement is separate from the forward flowing serpentine flow circuit in this embodiment. In the aft section of the blade, an upward flowing first leg is located along the trailing edge region of the blade, the second leg is a downward flowing suction side channel, and the third leg is an upward flowing pressure side channel to form the forward flowing serpentine flow circuit of the dual triple pass serpentine flow cooling circuit.

The dual triple pass serpentine flow cooling circuit of the present invention maximizes the airfoil rotational effects on the internal heat transfer coefficient and enhances manufacturability due to the high aspect ration cavity geometry. The cooling circuit achieves a better airfoil internal cooling heat transfer coefficient for a given cooling supply pressure and flow level. Pin fins can also be incorporated in these high aspect ration cooling channels to further increase internal cooling performance. A lower airfoil mass average sectional metal temperature and a higher stress rupture life is achieved.

DETAILED DESCRIPTION OF THE INVENTION

Figure 1A:
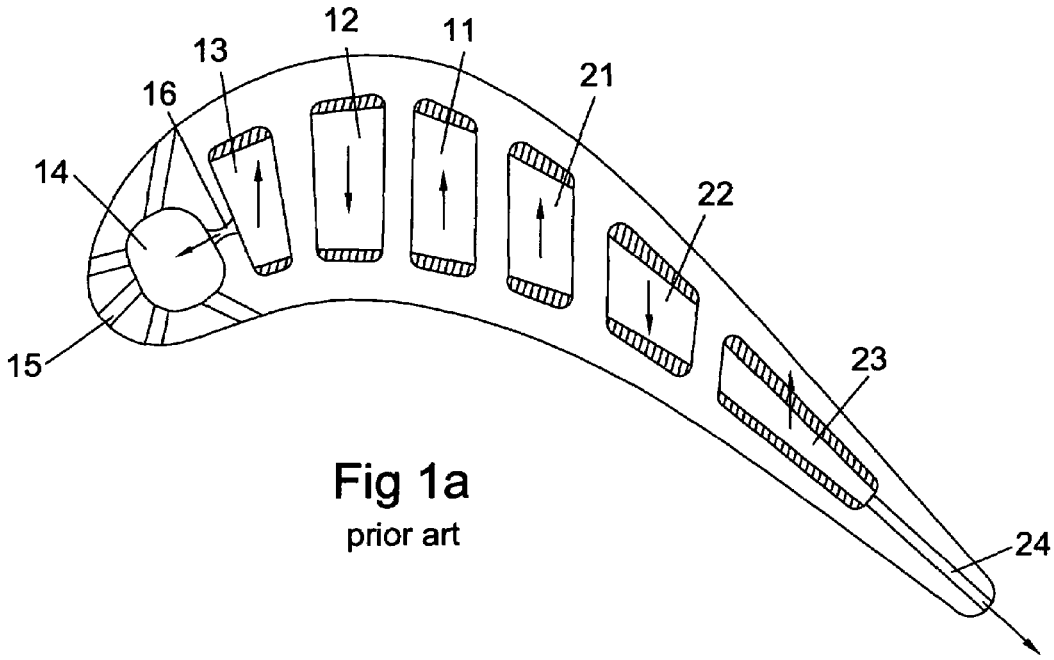
Fig 1a prior art
FIG. 1*a* shows a cross section view of a prior art dual triple pass serpentine flow cooling circuit known as a warm bridge.
Figure 1B:
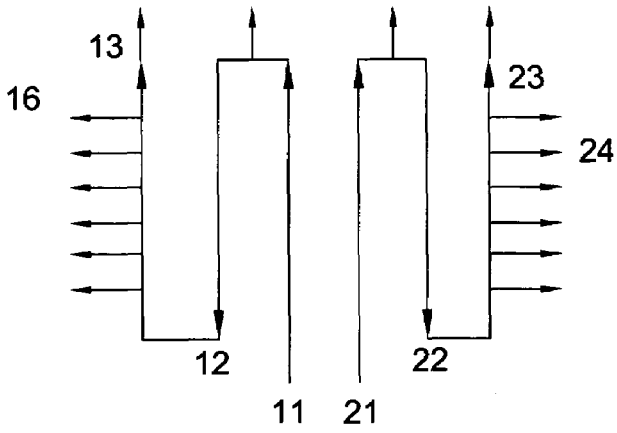
Fig 1b prior art
FIG. 1*b* shows a schematic depicting the cooling air flow directions of the serpentine flow circuit of FIG. 1*a*.
Figure 2A:
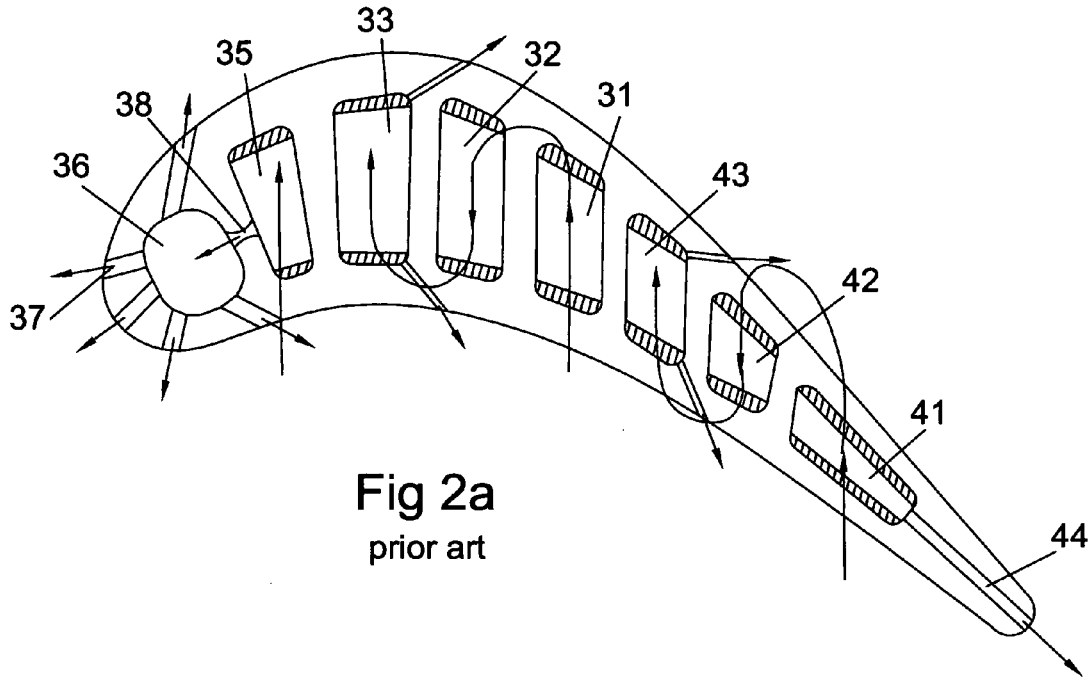
Fig 2a prior art
FIG. 2*a* shows a cross section view of a prior art 1+3+3 serpentine flow cooling circuit known as a cold bridge.
Figure 2B:
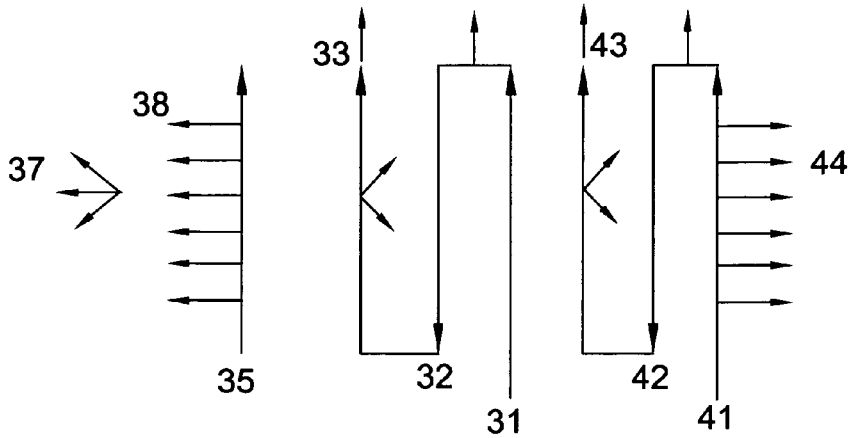
Fig 2b prior art
FIG. 2*b* shows a schematic depicting the cooling air flow directions of the serpentine flow circuit of FIG. 2*a*.
Figure 3:
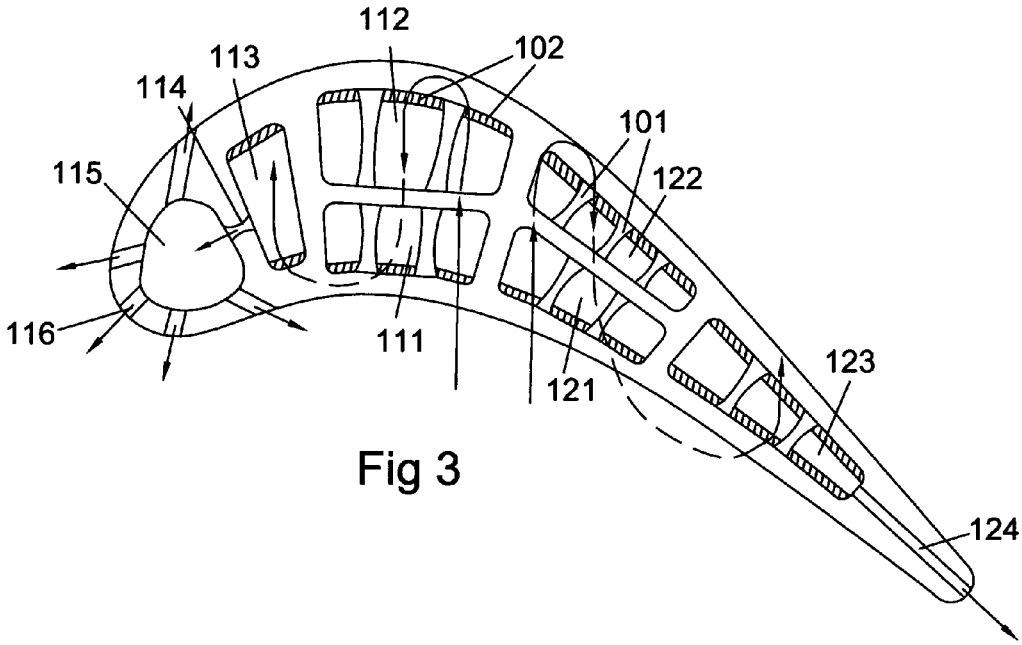
FIG. 3 shows a first embodiment of the dual triple serpentine flow cooling circuit of the present invention.

A gas turbine engine rotor blade is shown in FIG. 3 and represents a first embodiment of the present invention. The blade includes a forward triple pass serpentine flow cooling circuit and an aft triple pass serpentine flow cooling circuit. the forward serpentine flow circuit includes a first leg or channel 111 on the pressure side of the blade, a second leg or channel 112 on the suction side, and a third leg or channel 113 located forward of the first and second legs and extending from the pressure side to the suction side of the blade. The cooling air flows upward in the first leg 111, over the blade tip region and into the second leg 112 in the blade downward direction, and then into the third leg 113 and in the upward direction. Cooling air flowing in the third leg 113 is metered through metering holes 114 into a leading edge channel 115, and then through film cooling holes 115 that form the showerhead cooling arrangement for the leading edge of the blade.

The second triple pass serpentine flow circuit of the blade is located aft of the above described triple pass serpentine flow cooling circuit, and is formed by a first leg or channel 121 located on the pressure side, a second leg 122 located on the suction side, and a third leg 123 located between the pressure and the suction sides. Cooling air flows from the root portion and into the first leg 121 in the upward direction, then over the tip region of the blade and into the second leg 122 in the downward direction, and then into the third leg 123 in the upward direction. Trailing edge exit holes 124 are connected to the third leg 123 and discharge cooling air out from the trailing edge region.

In both of the two or dual triple pass serpentine flow circuits above, each leg or channel includes pin fins 101 extending across the channel and trip strips 102 positioned along the hot wall to increase the heat transfer coefficient of the channel.

Figure 4:
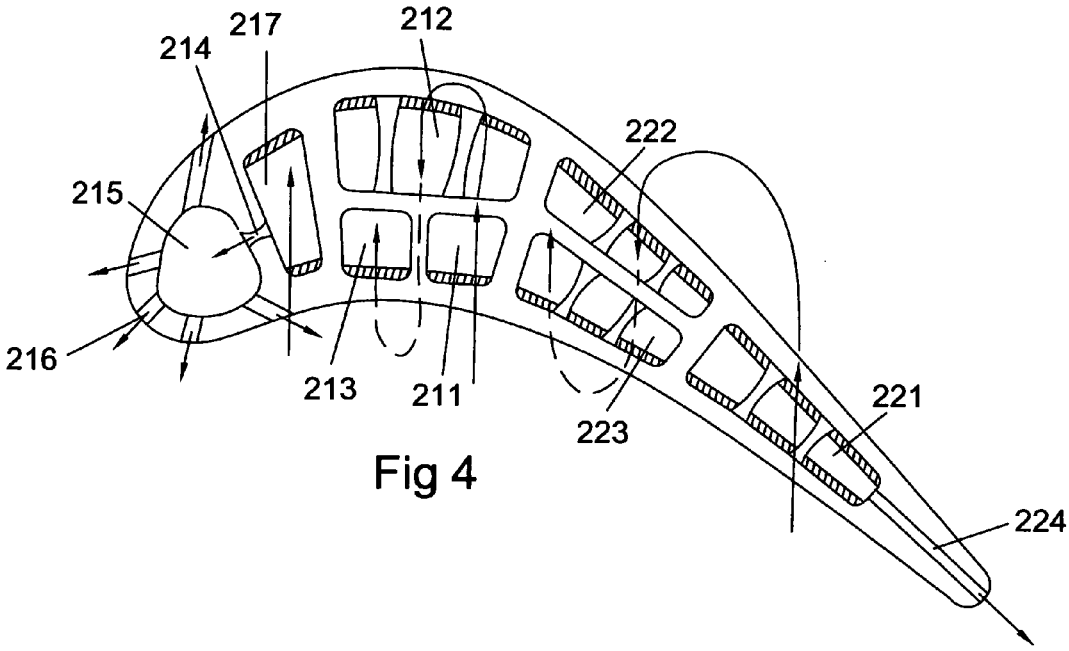
FIG. 4 shows a second embodiment of the 1+3+3 serpentine flow cooling circuit of the present invention.

In a second embodiment of the present invention shown in FIG. 4, the forward triple pass serpentine flow cooling circuit is separate from the aft triple pass serpentine flow circuit. the forward triple pass serpentine flow circuit includes a first leg 211 formed on the pressure side of the blade, a second leg 212 formed on the suction side, and a third leg 213 located on the pressure side and adjacent to the first leg 211. the first leg 211 is supplied with cooling air from the blade root passage and flows upward and over the blade tip, then into the second leg 212 in a downward direction, and then into the third leg 213 in the upward direction and discharged through blade tip cooling holes and/or pressure side film cooling holes on the blade pressure wall. Cooling air to the showerhead is supplied through a separate cooling supply channel 217, through metering holes 214 and into the leading edge channel 215, and through the showerhead film cooling holes 216. The aft triple pass serpentine flow cooling circuit includes a first leg 221 formed between the pressure and suction side walls with an upward flow direction and trailing edge exit holes 224, a second leg 222 on the suction side with a downward flow direction, and a third leg 223 on the pressure side with an upward flow direction. As in the first embodiment, the channels includes one or more pin fins and trip strips along the hot wall surfaces to increase the heat transfer coefficient of the channel.

The pressure side and suction side channels of the serpentine flow circuits of both embodiments above can include film cooling holes to discharge cooling air onto the pressure or suction side walls of the blade. Also, the last leg of the serpentine flow circuit can include blade tip cooling holes to discharge cooling air from the end of the leg. Also, the bend from the first leg to the second leg located in the tip region can also include tip cooling holes.

I claim the following:

1. A turbine blade having a root portion and an airfoil portion, the root having a cooling air supply passage to supply cooling air to the airfoil portion, the blade comprising:

an first serpentine flow cooling circuit including a first leg formed from a cooling channel on the pressure side of the blade, a second leg formed from a cooling channel on the suction side and adjacent to the first leg, and a third leg formed between the pressure side and the suction side and located forward of from the first and second legs;

a second serpentine flow cooling circuit located downstream from the first serpentine flow cooling circuit and including a first leg formed from a channel located on the pressure side of the blade, a second leg formed from a channel located on the suction side and adjacent to the first leg, and a third leg formed from a channel between the pressure side and the suction side;

a plurality of cooling air exit holes in communication with the third leg of the second serpentine flow circuit; and, a showerhead arrangement and a leading edge cooling channel located in the leading edge region of the blade and in communication with the third leg of the first serpentine flow circuit through a plurality of metering holes.

2. The turbine blade of claim 1, and further comprising:

the channels include pin fins and trip strips to increase the heat transfer coefficient of the channels.

3. The turbine blade of claim 1, and further comprising:

the first leg and second leg of the first serpentine flow circuit has substantially the same chordwise length along the blade.

4. The turbine blade of claim 3, and further comprising:

the first leg and the second leg of the second serpentine flow circuit have substantially the same chordwise length along the blade.

5. A turbine blade having a root portion and an airfoil portion, the root having a cooling air supply passage to supply cooling air to the airfoil portion, the blade comprising:

an first serpentine flow cooling circuit including a first leg formed from a cooling channel on the pressure side of the blade, a second leg formed from a cooling channel on the suction side, and a third leg formed from a channel located on the pressure side, the first and third legs are substantially opposed to the second leg;

a second serpentine flow cooling circuit located downstream from the first serpentine flow cooling circuit and including a first leg formed from a channel located between the pressure side and the suction side and adjacent to the trailing edge of the blade, a second leg formed from a channel located on the suction side and aft of the first leg, and a third leg formed from a channel on the pressure side of the blade and adjacent to the second leg;

a plurality of cooling air trailing edge exit holes in communication with the first leg of the second serpentine flow circuit;

a leading edge cooling supply channel located forward of the first serpentine flow circuit; and, a showerhead arrangement and a leading edge cooling channel located in the leading edge region of the blade and in communication with the leading edge cooling supply channel through a plurality of metering holes.

6. The turbine blade of claim 5, and further comprising:

the channels include pin fins and trip strips to increase the heat transfer coefficient of the channels.

7. The turbine blade of claim 5, and further comprising:

the first leg and third leg has a combined chordwise length substantially the same as the chordwise length of the second length of the first serpentine flow circuit.

8. The turbine blade of claim 7, and further comprising:

the second leg and the third leg of the second serpentine flow circuit have substantially the same chordwise length along the blade.

* * * * *